United States Patent [19]

Stevens

[11] 4,396,218

[45] Aug. 2, 1983

[54] SPREADER SYSTEM FOR HANDLING CONTAINERS

[75] Inventor: Alan R. Stevens, Roxboro, N.C.

[73] Assignee: RPC Corporation, Roxboro, N.C.

[21] Appl. No.: 959,056

[22] Filed: Nov. 9, 1978

[51] Int. Cl.[3] ..... B66C 1/42

[52] U.S. Cl. ..... 294/815 F

[58] Field of Search ..... 294/815 F, 81 R, 67 R, 294/67 D, 67 DA, 67 B; 414/608, 620, 621, 730

[56] References Cited

U.S. PATENT DOCUMENTS

| | | | |
|---|---|---|---|
| 3,858,728 | 1/1975 | Fathauer | 294/815 F |
| 3,871,697 | 3/1975 | Bechtloff | 294/815 F |
| 3,885,676 | 5/1975 | Wilson et al. | 294/815 F |

*Primary Examiner*—James B. Marbert

*Attorney, Agent, or Firm*—Shlesinger, Arkwright, Garvey & Dinsmore

[57] ABSTRACT

An improved radio-controlled spreader for handling cargo containers is disclosed having a number of improved safety features. A switching circuit, including proximity switches mounted on the respective corners of the spreader for sensing contact with the cargo container, controls the locking and unlocking circuits for twist locks which engage the container. The switching circuit prevents premature locking and accidental unlocking. The expansion and retraction circuit for the spreader includes swtiching means for controlling the flow of hydraulic fluid to the spreader in its expanded position which in cooperation with the hydraulic circuit prevent damage from external forces applied to the spreader ends. In addition, a backup safety circuit, which includes pressure switches in the hydraulic locking and unlocking circuit, is disclosed to reduce the possibility of excessive hydraulic pressure overcoming the lock position of the twist locks if the operator accidentally selects an unlock position while a container is suspended by the spreader and the proximity switches are out of adjustment. The mechanical, electrical and hydraulic aspects of these features are disclosed.

13 Claims, 9 Drawing Figures

TO ENGINE STARTER
TO CONTROLLER ON ENGINE 79
83
82
81
84
85
80
86
87
88
R1
R2
R3
R4
R5
R6
LOWER OUTBOARD ARMS
RAISE OUTBOARD ARMS
UNLOCK TWIST LOCKS
LOCK TWIST LOCKS
LOWER INBOARD ARMS
RAISE INBOARD ARMS
140
141
A
B
S1
S2
S3
S4
R8
R9
R10
R11
95
98
LS1
LS2
LS3
LS4
LS5
LS6
R7
89
SOL 1
EXPAND SPREADER (40 FT.)
RETRACT SPREADER (20 FT.)
SOL 2
SOL 3
SOL 4
SOL 5
96
131
129
130
92
93
R8 R9 R10 R11
SOL 6
SOL 7
SOL 8
SOL 9
SOL 10
SOL 11
SOL 12
SOL 13
SOL 14

SPREADER SYSTEM FOR HANDLING CONTAINERS

BACKGROUND OF THE INVENTION

This invention relates to an improved cargo container spreader or grappler spreader which includes radio-controlled apparatus for accomplishing the functions for which the spreader is designed. More particularly, this invention relates to switching means, including proximity switches on the four corners of the spreader, to control energization of the locking and unlocking circuits for the container-engaging twist locks. In addition, this invention relates to an improved expansion and retraction circuit and to a backup safety circuit for the locking and unlocking circuits of the spreader.

U.S. Pat. No. 3,858,728 discloses a crane and spreader combination for handling cargo containers which includes a spreader lacking the usual cable supply power facilities. A portable self-sufficient power unit with quick disconnect fittings mates with corresponding fittings of the spreader. The crane is equipped with a radio transmitter and the spreader with a radio receiver for controlling by radio the various features and functions of the spreader apparatus. That patent (hereinafter referred to as the '728 patent) is assigned to the assignee of this invention and is hereby incorporated by reference.

The '728 patent discloses a latch system for locking the spreader to a container, a plurality of corner guides movable into and out of an operable position relative to the container which guides in a lower operable position assure registry of a spreader with a container and a mechanism for expanding and contracting the length of the spreader and actuation of the grappler arms, among other features.

It is desirable to improve the operation of a spreader of the type described in the '728 patent by the inclusion of additional safety features to prevent the premature locking and accidental unlocking of the twist locks, particularly since the electrical and hydraulic circuits on the spreader are radio controlled from a transmitter located in the cab of a crane. A reason for such an aim is because the operator may be positioned where his view of the container is obstructed. In addition, it is desirable to provide a hydraulic safety circuit for sensing and controlling the pressure in the hydraulic locking and unlocking circuit to prevent accidental unlocking while the container is suspended. In addition, it is desirable to improve the expansion and retraction circuit, especially when the spreader is extended at or near its outermost position.

Accordingly, it is a principal object of this invention to provide an improved spreader arrangement and particularly a radio-controlled spreader, for handling containers which arrangement includes safety circuits for preventing the premature locking and accidental unlocking of the twist locks under various conditions.

It is another object of this invention to provide for a radio-controlled expandable spreader which has an improved expansion and retraction circuit.

It is another object of this invention to provide a switching circuit, including proximity switches on the four corners of the grappler spreader, to sense the presence of the container and thus to control the energization of the locking and unlocking circuits on the spreader in order to prevent premature locking and accidental unlocking.

It is another object of this invention to provide a backup safety circuit for the hydraulic locking and unlocking circuits to prevent an inadvertent unlocking of the twist lock in the event an operator accidentally selects an unlock position while a container is suspended by the spreader and the proximity switches are out of adjustment.

These and other objects, aims and advantages of the invention will become apparent from the following written description of the invention, taken in conjunction with the accompanying drawings.

BRIEF SUMMARY OF THE INVENTION

The present invention resides in the provisions of additional safety circuits to a radio-controlled spreader for handling cargo containers. The spreader comprises an expandable frame, a latching system for locking the spreader to a container, means for moving a plurality of corner guides into and out of operable position relative to a cargo container which in the lower operable position assure registry of a spreader with a container, means for expanding and contracting the length of the spreader. Radio receiver means are provided on the spreader responsive to radio signals transmitted from the cab of the crane to accomplish the various functions as has been described in the '728 patent.

The invention, in one aspect, relates to the use of means for sensing a close proximate relationship between the spreader and the container. Preferably, the sensing means includes proximity switches mounted on the four respective corners of the spreader. When the switches are all closed, indicating close or proximate contact between the spreader and the container, the locking and unlocking circuits for actuating the twist locks to engage the container can be actuated. Thus, the proximity switches control the energization of the locking and unlocking circuits and thus prevent premature locking in a state where the twist lock has not engaged the container. In addition, the electrical and hydraulic circuits provide sufficient interlocks responsive to the switching state of the proximity switches on the spreader to prevent accidental unlocking of the circuit in the event the operator accidentally transmits an unlock signal.

An improved expansion and retraction circuit for the spreader is a second feature of the invention. Switch means are provided for actuation by an end of the spreader as it approaches its fully expanded length to control the flow of hydraulic fluid on the hydraulic cylinders causing the expansion. In the event the spreader wedges in the cell of a ship, for example, and the operator applies a lifting force to lift the spreader from the cell, the cylinder rods are forced to retract to release and hydraulic fluid is released. On the other hand, as soon as the external force is removed, a pressure compensated pump supplies makeup hydraulic fluid and returns the spreader ends to the expanded position. This feature acts as a means to prevent damage from reasonable external forces to the spreader ends, particularly in the expanded position.

A backup safety circuit is also provided according to the invention which consists of pressure switches connected in circuit with the hydraulic twist locks to continually sense pressure in the locking and unlocking hydraulic lines. The use of the output signals from the pressure switches reduces the possibility that excessive pressure in the hydraulic system will overcome the locked position of the twist locks in the event that the operator accidentally selects an unlock position while a container is suspended by the spreader if the proximity switches, mentioned above, are out of adjustment. If the hydraulic pressure exceeds a predetermined pressure setting, as sensed by the pressure sensitive switches, contacts open the circuit to the valve unlocking solenoid to provide an individual indication of this state. Under these conditions, the twist locks would not be able to move to an unlock position until the locking and unlocking pressure is reduced to a normal working amount. For maintenance purposes, the safety circuit can be bypassed.

DETAILED DESCRIPTION OF THE PREFERRED EMBODIMENTS

Figure 1:
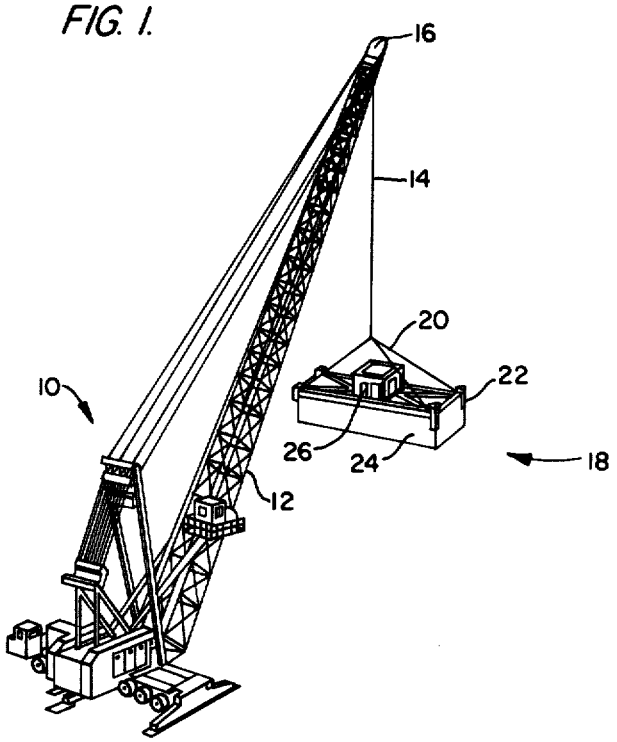
FIG. 1 is a perspective view of a crane and spreader combination showing a cargo container attached to a radio-controlled spreader according to the invention.

FIG. 1 depicts a mobile crane 10 comprising a boom 12 equipped for reeling in or feeding out a cable 14 to adjust the length of a pendant portion of the cable 14 with reference to a suspension point in the top end 16 of the boom 12. As shown, a spreader 18 is connected to a single-point suspended relation with the cable 14 by a sling 20. The spreader 18 is shown with its corner guides 22 in a downward position along the vertical dihedral corners of a container 24 latched to the spreader. In combination with the spreader is a self-sufficient portable power unit 26 resting on upper platform surfaces of the spreader as provided by horizontally extending members of the spreader frame. The power unit 26 is prevented from shifting horizontally along supporting surfaces of the spreader 18 by appropriate connections to the frame of the power unit.

Figure 4:
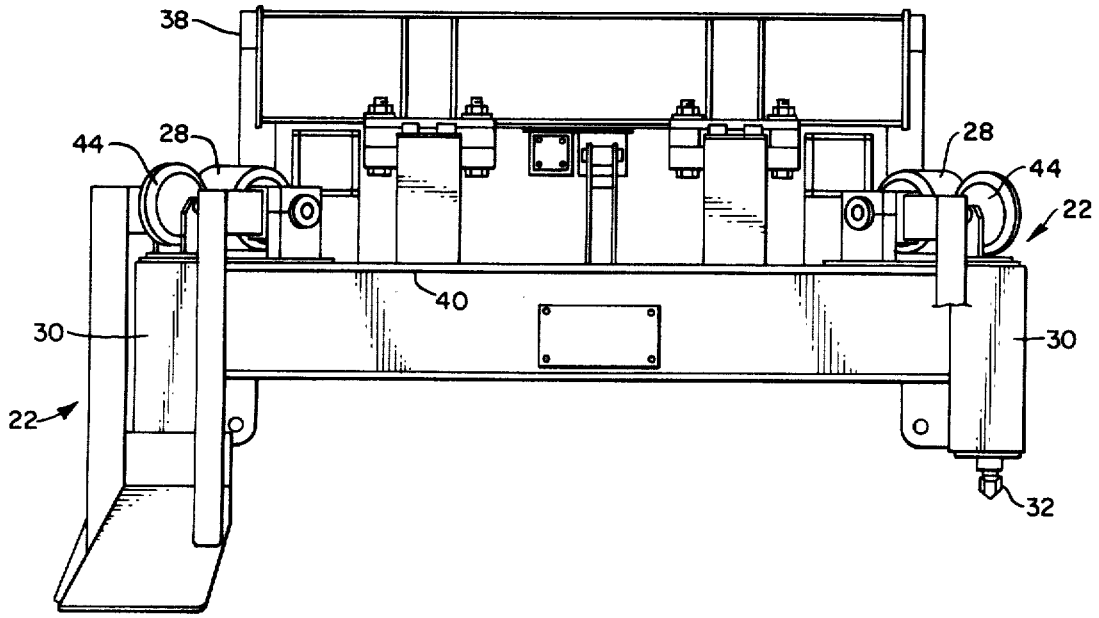
FIG. 4 is a end elevational view of the spreader of FIGS. 2 and 3.
Figure 2:
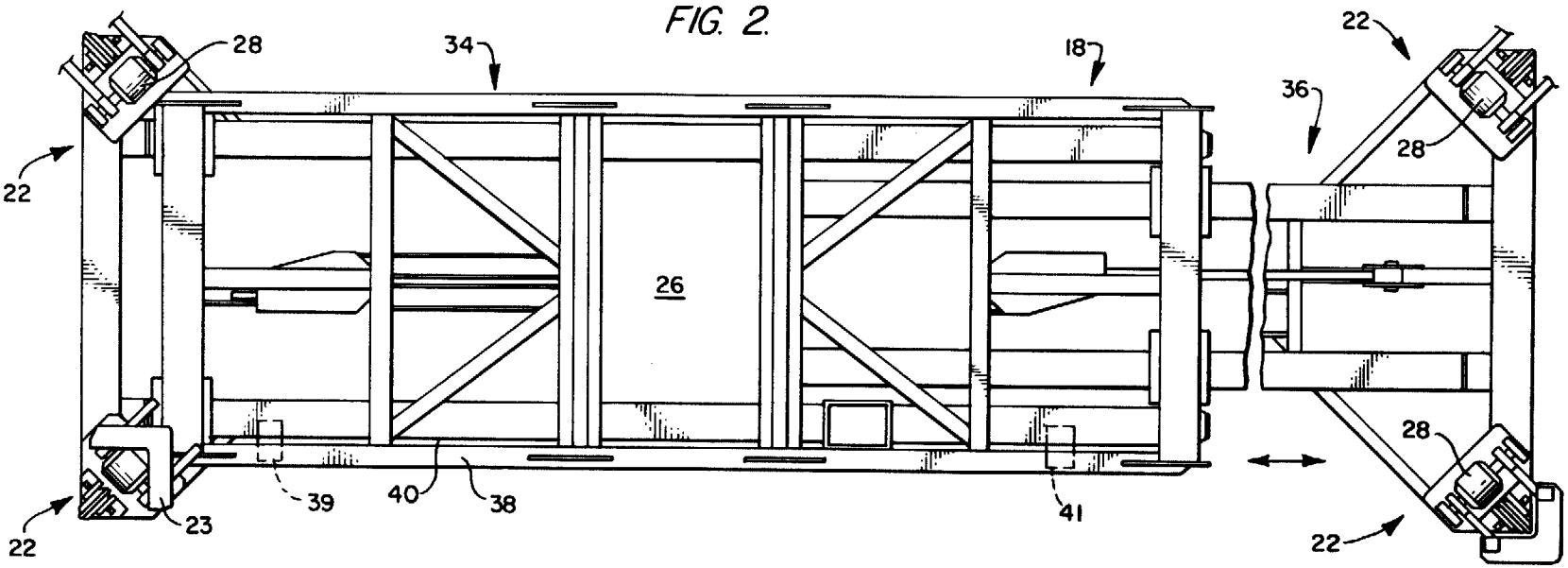
FIG. 2 is a top plan view of the radio-controlled expandable spreader according to the invention.
Figure 3:
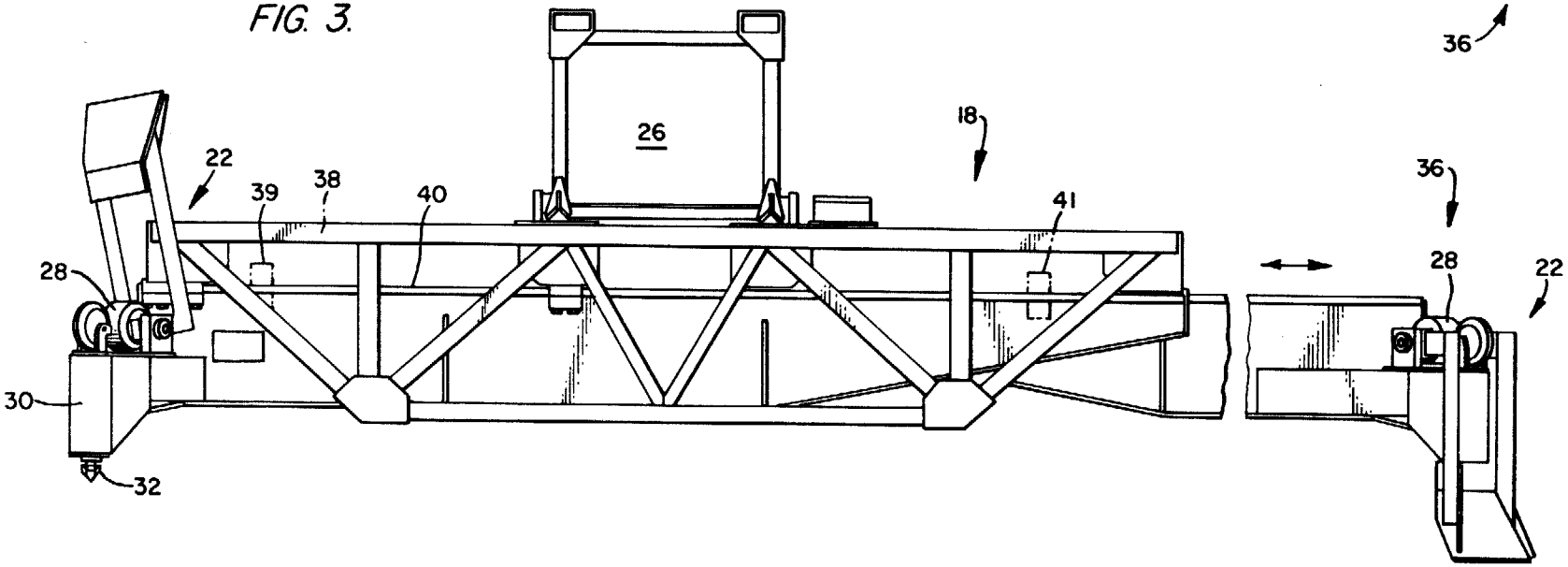
FIG. 3 is a front elevational view of the radio-controlled expandable spreader according to the invention showing one of the corner aligning arms in its retracted position and the other in its lowered position.

In the embodiment herein presented, as best seen in FIGS. 2–4, the spreader service mechanism consists of four corner guides 22 which include an aligning arm assembly 23 and which are driven by hydraulic rotary motors 28 mounted atop latch housings 30 for enclosing the mechanisms of conventional standard twist lock latches 32 for engaging the container 24 and locking the spreader 18 to it.

The spreader 18 includes a fixed portion 34 and an expandable portion 36 which can be extended and retracted by hydraulic power means on the spreader as is known in the art. The fixed portion 34 includes upper frame members 38 while the lower portion includes lower frame members 40 which move relative thereto. The details of the power unit 26 and the hydraulic extension mechanism need not be shown in detail. Each corner guide 22 also includes a corner roller assembly 44.

A expanded position limit switch is designated in phantom outline by the reference numeral 39. Also an expanded position limit switch is designated by the reference numeral 41. The switch components are arranged to "trip" when the expandable portion 36 of the spreader is at its outward limit (at switch 39) and its outward limit (at switch 41). A limit switch trip is secured to the lower frame member 40 to actuate a switch on the upper frame member 38.

Figure 5:
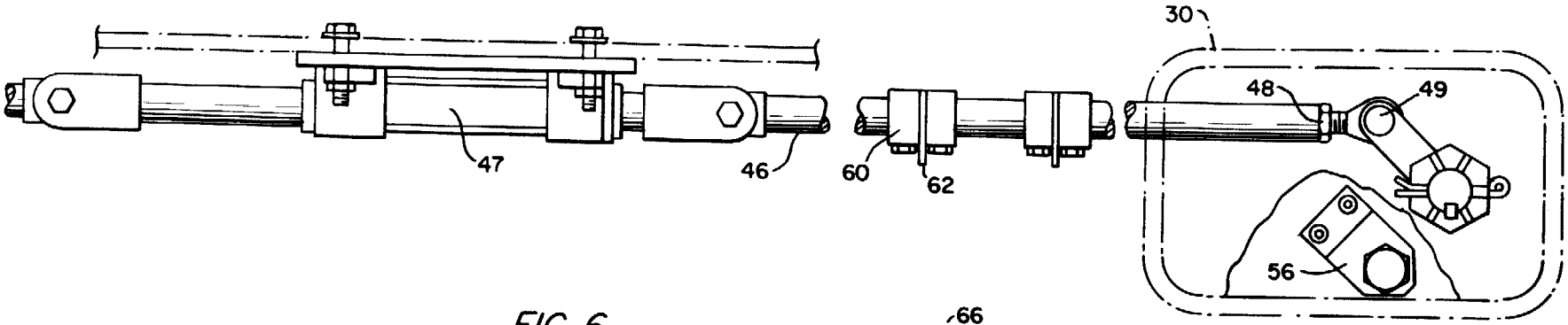
FIG. 5 is a top elevational view of the twist lock linkage assembly for use in the spreader according to the invention.
Figure 6:
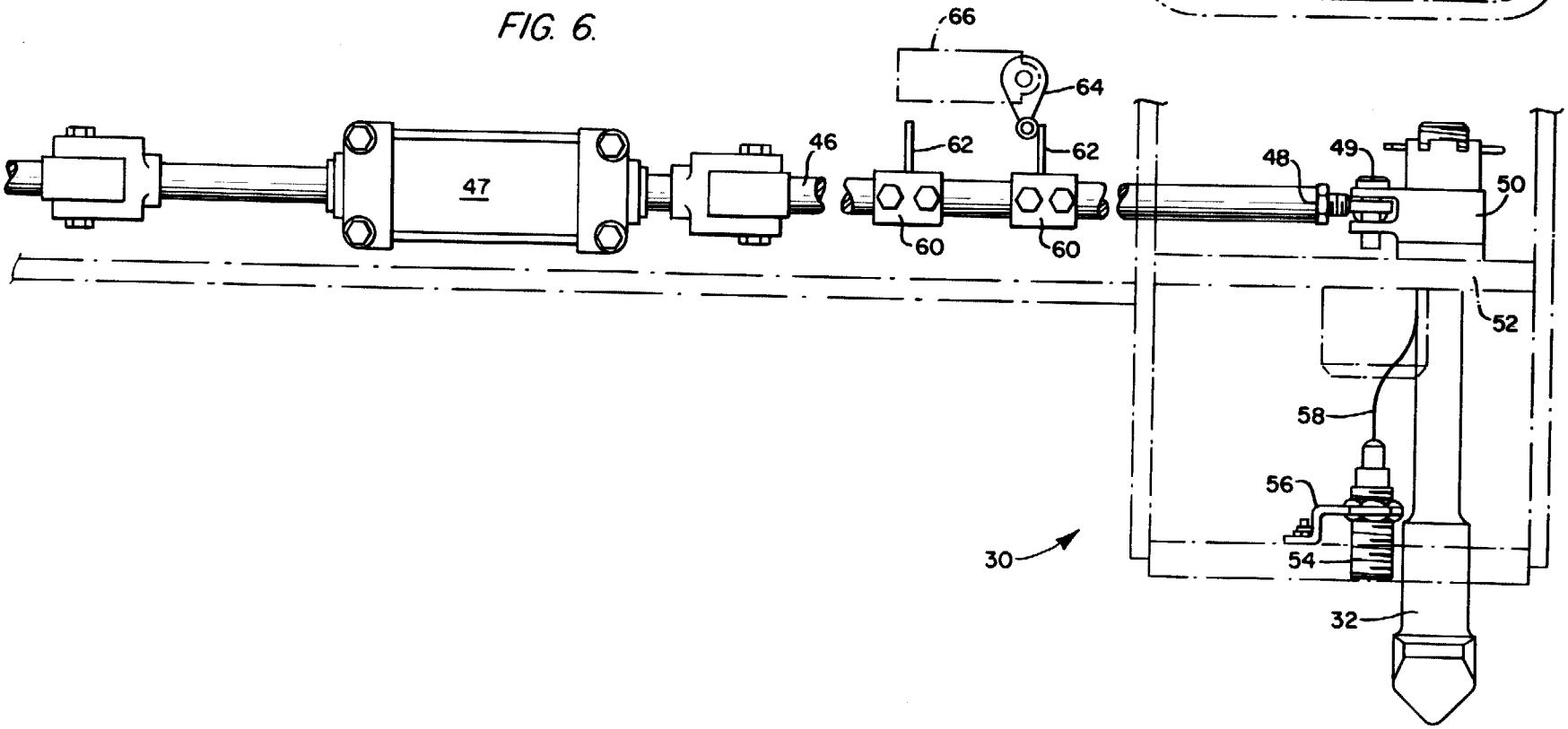
FIG. 6 is a side elevational view of the twist lock linkage assembly for use in the radio-controlled spreader according to the invention.

FIGS. 5 and 6 illustrate the details of the twist lock linkage assembly for use in the spreader according to the invention. These figures show only one half of the assembly from about the centerline of the unit since the other half is identical. A linkage bar 46 is connected at its rod end 48 by clevis pin 49 to its twist lock actuator 50 mounted on a support 52 in the twist lock linkage assembly 30. Actuation of the linkage bar 46 by an actuator 47 causes rotation of the twist lock 32 by virtue of rotation about its axis caused by the twist lock actuator 50. As is well known, rotation of the twist lock 32 through about 90° respectively causes the locking and unlocking state for each twist lock.

Each twist lock linkage assembly 30 includes a proximity switch 54 mounted in the housing in such a position as to be able to sense the proximity of the container when the spreader is positioned adjacent to the container for actuation of the switch lock. The purpose of the proximity switch is to provide a condition sensing signal which is utilized by the electrical and hydraulic circuits of the spreader to prevent premature locking of the twist lock 32 in response to an inadvertent signal from an operator while a container is secured to the spreader. The position of the switch 54 can be adjusted relative to a switch mounting plate 56 secured to a member 58 in the twist lock linkage assembly.

An electrical lead 58 provides the output of the proximity switch 54. While the proximity switch may be a normally-open type which closes upon a proximate relationship to the container, other suitable types of proximity sensing switches may also be sued.

FIGS. 5 and 6 also show a plurality of adjustable slide members 60 secured to the linkage bar 46 in a spaced relationship. The slide members 60 include laterally extending arms 62 arranged in a spaced relationship to engage the idler 64 on a lock/unlock limit switch 66. The limit switch contacts will be discussed in connection with the circuits of FIGS. 7–9.

Figure 7:
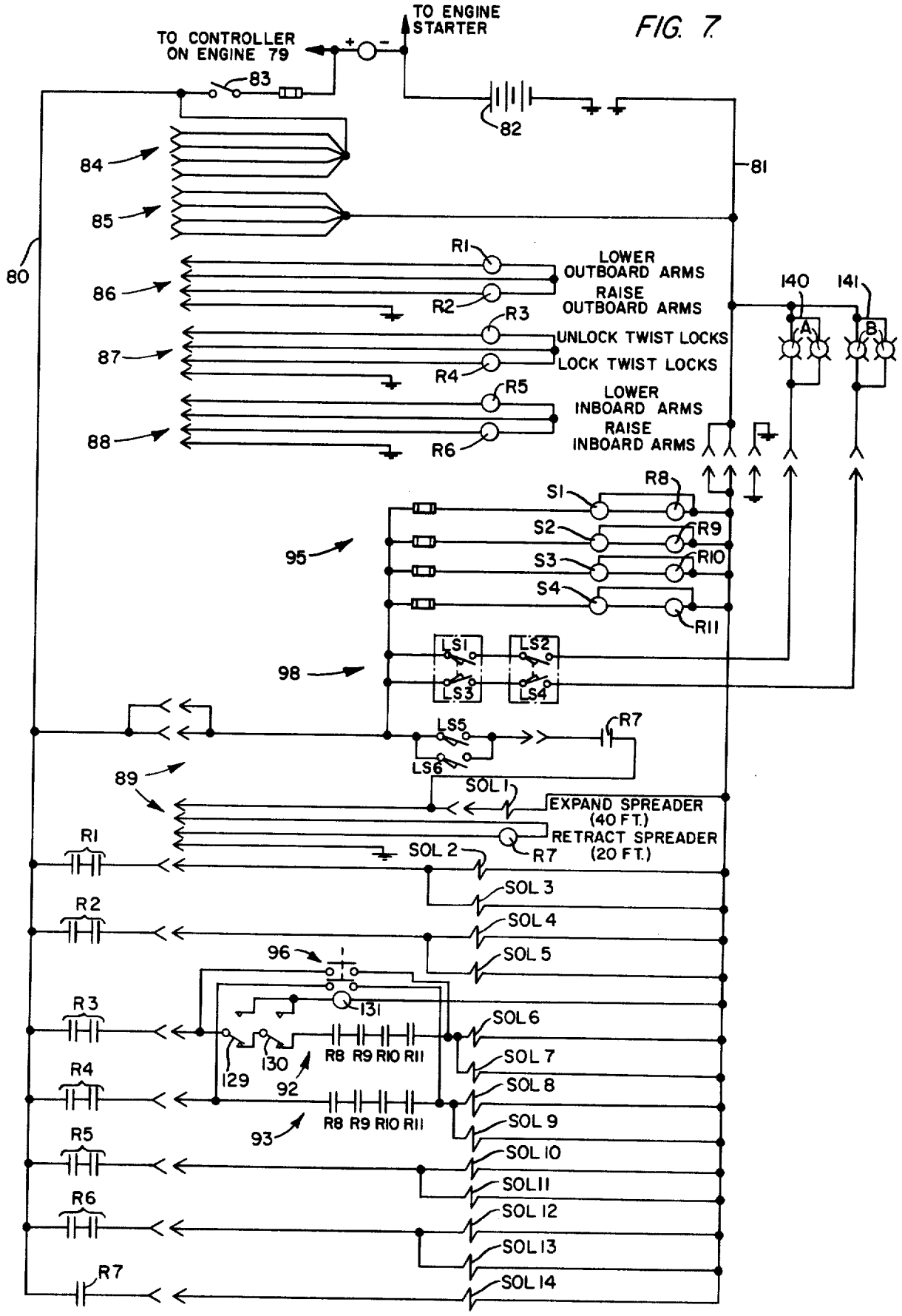
FIG. 7 is an electrical circuit diagram for operating the spreader according to the invention, particularly including the safety interlocking circuits.

FIG. 7 shows an electrical schematic circuit diagram for the radio-controlled expandable spreader according to the invention. The electrical circuit includes a pair of main circuit leads 80 and 81 connected in circuit with a DC source of power 82, such as a battery, the alternator on the engine 79, and a power switch 83. A circuit, designated generally by the reference numeral 84 is connected to the power source 82 to provide power to the receiver located on the spreader, as described in detail in the '728 patent. The negative power supply for the receiver is designated generally by the reference numeral 85.

A plurality of circuits 86, 87 and 88 are connected to the receiver output through pin connections to actuate respectively, the outboard arms, the twist locks, and the inboard arms. The aligning inboard and outboard arms are raised and lowered by selecting the appropriate toggle switch on the transmitter, described in detail in the '728 patent, which will send a signal to the receiver, energizing the relay coils R1, R2, R5 or R6, as required. For example, when it is desired to lower the outboard arms, a toggle switch on the transmitter is actuated sending a signal which is received on a receiver and transmitted by the circuit 86 to energize the coil R1. When the coil R1 is energized, the relay contacts R1 are closed and the solenoids SOL2 and SOL3 are energized to actuate and lower the outboard arms, by the hydraulic circuits shown in FIG. 8.

Figure 8:
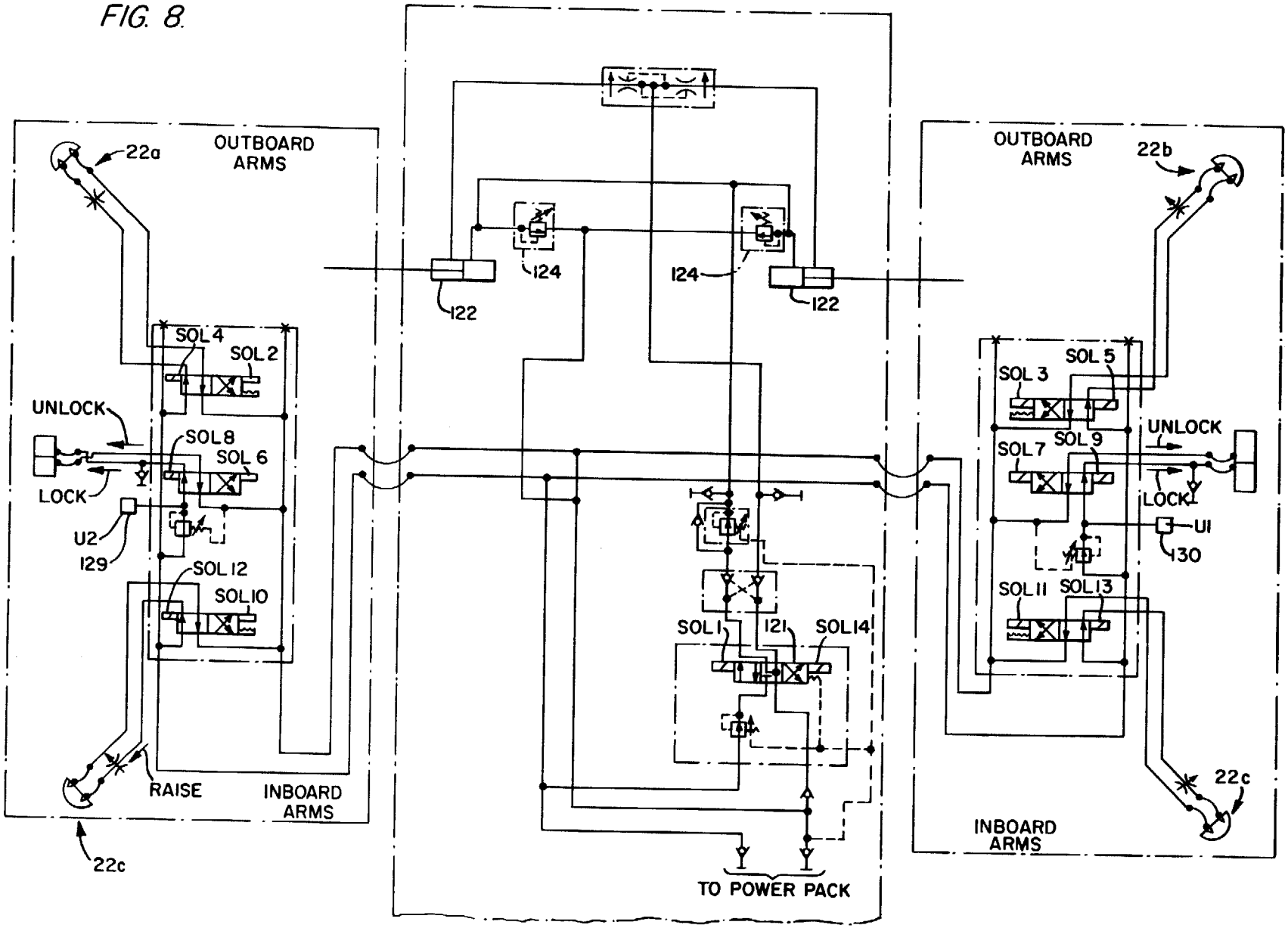
FIG. 8 is a hydraulic schematic diagram of the operation of the hydraulic features of the invention, particularly including the safety interlock circuits.

Similarly, actuation of the coil R2 in the manner described to raise the outboard arms will energize the coil R2 to close the contacts R2 to energize the solenoids SOL4 and SOL5 to raise the outboard arms according to the circuit of FIG. 8.

Similarly, a signal from the transmitter to the receiver on circuit 88 to lower the inboard arms energizes the coil R5, closing the contacts R5 to energize the solenoids SOL10 and SOL11. Energization of the solenoids SOL10 and SOL11 operates to lower the inboard arms according to the circuit of FIG. 8.

Likewise, an appropriate signal to raise the inboard arms is received by the circuit 88 to energize the coil R6 which closes the contacts R6 to energize the solenoids SOL12 and SOL13 to raise the inboard arms, as seen by the hydraulic circuit diagram of FIG. 8.

In FIG. 8, the outboard arms are designated by reference numerals **22*a* and 22*b* while the inboard arms are designated by reference numerals 22*c* and 22*d*. Lowering solenoid SOL2 is in circuit with arm 22*a* while solenoid SOL3 is in circuit with arm 22*b*, for lowering each. Raising solenoid SOL4 is in circuit with outboard arm 22*a* while raising solenoid SOL5 is in circuit with outboard arm 22*b*. Similarly, lowering solenoid SOL10 actuates inboard arm 22*c* while lowering solenoid SOL11 lowers arm 22*d*. Raising solenoid SOL12 raises inboard arm 22*c* while solenoid SOL13 raises arm 22*d***.

When the operator releases the toggle switch on the transmitter, the hydraulic directional control valves, as shown in FIG. 8, will remain in the last position set to maintain a static hydraulic pressure as provided by a pressure compensator pump to maintain the arms in the last position shown.

The circuit of FIG. 7 also controls the expansion and retraction of the spreader. Assuming that the operator selects the retract position on the transmitter, a retract signal is sent to the receiver on the spreader. The receiver in turn causes the energization of the coil R7 in the circuit 89 which causes the normally open contact R7 to close to energize the solenoid SOL14. The solenoid SOL14, located on the stationary frame (see FIG. 8) thus operates to retract the spreader. When the solenoid SOL14 is energized, the directional control valve 121 directs oil flow to retract the cylinders 122, as shown in FIG. 8. When the operator releases the toggle switch, the valve spool returns to its center off position as pictured on the hydraulic schematic circuit of FIG. 8.

The spreader expansion circuit works similarly. When the operator selects the expand position on the transmitter, a signal is provided to the receiver on the spreader. The receiver in turn causes current to flow to the solenoid SOL1 in the circuit 89 causing a directional control valve 121 to direct oil flow to expand the cylinders 122 as shown in FIG. 8. In the event that an operator releases the toggle switch anywhere from a twenty foot spreader position to almost the maximum forty foot spreader position, the valve spool returns to its center off position as shown in the center in the hydraulic schematic diagram of FIG. 8. As each spreader end approaches within eight inches of its expanded length (to the forty foot total limit) the limit switch contacts LS5 and LS6 in circuit 91 (FIGS. 8 and 9) close allowing continuous current flow to the solenoid SOL1 through the normally closed contact R7. This permits a clear path of hydraulic oil through the directional control valve 121 to maintain pressure on the rear end of the hydraulic cylinders 122 in the expansion direction. In the event that the spreader ends wedge in the cell of the ship, for example, and the operator applies force to lift the spreader outwardly, the cylinder rods are forced to retract and the trapped oil will be forced out through relief valves 124 back to the hydraulic reservoir 125. As soon as the external force is removed from the ends of the spreader, the pressure compensated pump automatically supply makeup oil and return the spreader ends to the full forty foot position. This feature acts as a cushion to prevent damage from reasonable external forces to the spreader ends.

The switches LS5 and LS6 correspond to the switches 39 and 41 described in connection with FIGS. 2–4.

The lock and unlock circuits are also controlled by the electrical circuit of FIG. 7. When the operator selects a lock or unlock position on the transmitter on the crane, the receiver on the spreader will respond by providing power to the relay coil R3 or the relay coil R4 in the circuit 87 connected to the receiver. Even though the relay contacts R3 or R4 are closed, the solenoid hydraulic valve cannot be energized unless the relay contacts R8 through R11 are also closed since they are wired in series with the solenoid coils. This can be seen from a review of the circuits designated generally by the reference numerals 92 and 93 in FIG. 7.

These contacts R8–R11 should only close when the spreader is resting on a container as controlled by the four sensor proximity switches S1 through S4, shown in the circuit 95, and designated by the numeral 54 in FIGS. 5 and 6. The corner sensors S1–S4 close only when the spreader is resting on a container and are open when the spreader is lifting a container or away from the container.

The proximity switches S1 through S4 detect the metal container corner fittings when the spreader is on a container allowing the relay coils R8 through R11 in the circuit 95 and respectively in series with the corner sensors S1 through S4 to be energized. Upon lifting the container, and when the spreader is away from the container, the proximity switches will not permit current flow to the relays.

In circuit 95, the switch S1 controls coil R8; S2 controls R9; S3 controls R10; and S4 controls R11. The circuits 92 and 93 show that all switches S1–S4 must be closed before any of the solenoids SOL6, SOL7, SOL8, and SOL9 are actuated. Those solenoids are also shown in FIG. 8.

A backup safety circuit is provided for the invention. The backup safety circuit consists of pressure switches 129 and 130 (FIG. 8) that are connected to the hydraulic twist lock circuit in such a way as to continually sense the pressure in the lock/unlock hydraulic line. The purpose of this design is to reduce the possibility of excessive pressure overcoming the locked position of the twist locks should the operator accidentally select an unlock position while a container is being suspended by the spreader if the proximity switches are out of adjustment. In addition, the safety circuit warns of high pressure in the twist lock components. The pressure switch contacts are wired in series with the unlock hydraulic control valve solenoid to control the twist locks unlocked position. Should the hydraulic pressure exceed a predetermined pressure setting, which would normally be caused by someone tampering with the normal pressure setting, the contacts (in circuit 92 in FIG. 7) would respond by breaking the circuit leading to the valve unlock solenoids SOL6 and SOL7. This in turn closes a circuit to a warning light 131. In this condition, the twist locks are not able to move into an unlock position until the lock/unlock pressure is reduced to a normal working amount. A pushbutton switch 96 bypasses the above safety circuit for maintenance purposes.

When the locks are in a lock position, the limit switch contacts LS1 and LS2 in circuit 98 close, allowing current flow to the amber indication lights 140. When in an unlocked position, the limit switch contacts LS3 and LS4 will close, giving an indication by blue lights 141. The contacts LS1–LS4 correspond to the switches 66 shown in FIG. 5.

Figure 9:
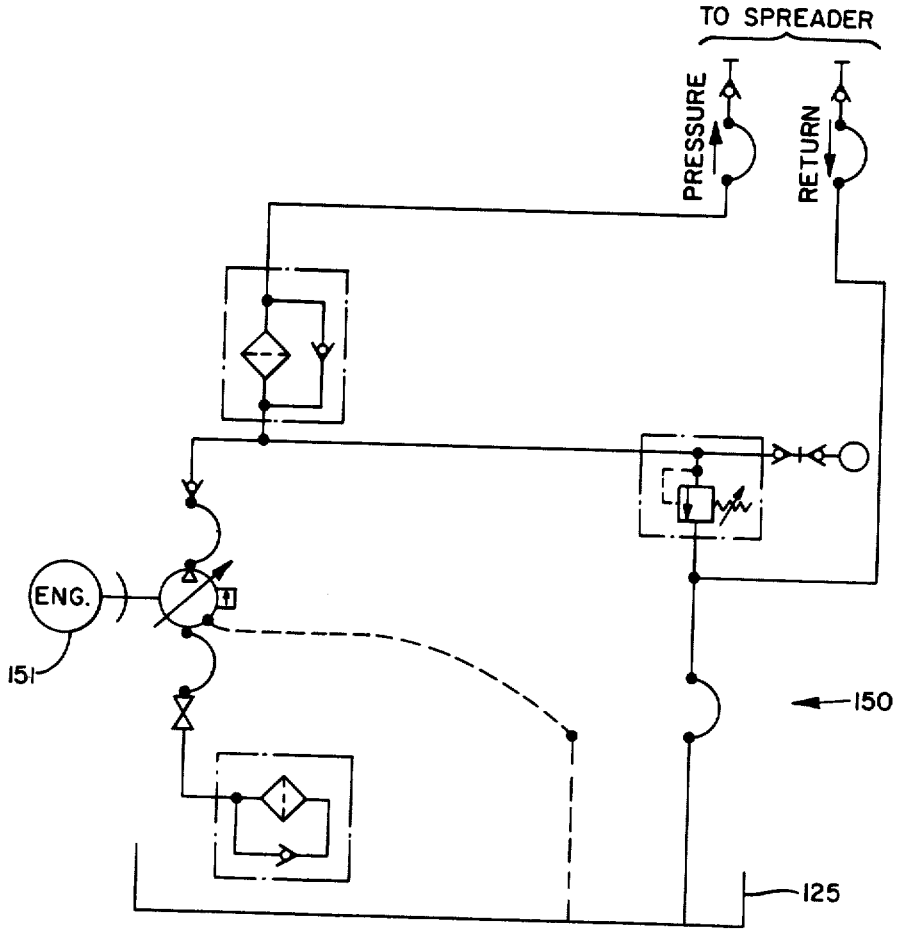
FIG. 9 is a hydraulic schematic diagram of the power pack for use with the spreader according to the invention.

FIG. 9 is a hydraulic circuit of the power pack 150 connected to the hydraulic circuit of the spreader and controlled by an engine 151.

All of the details concerning the overall operation of the hydraulic schematics are not discussed in detail. However, standard graphic symbols for fluid power diagrams published by the American Society of Mechanical Engineers (ASME) have been used. The nature and function of elements not specifically mentioned herein may be determined by recourse to publications of the ASME on standard symbols.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. In a spreader of the type comprising a spreader frame, twist lock actuating means for actuating a plurality of twist locks to engage said frame with a container, each of said twist locks having an upper end and a lower end, electrical circuit means for receiving an electrical command signal to lock or unlock the twist locks and hydraulic means responsive to said electrical circuit means for causing the locking and unlocking of said twist locks, the improvement comprising:

a plurality of brackets mounted to said frame and each of said brackets being adjacent one of said twist locks and a plurality of proximity sensing means, each of said proximity sensing means being fixedly secured to one of said brackets to maintain each of said proximity sensing means a fixed distance from said adjacent twist lock lower end and for sensing the proximity of said spreader relative to said electrical container without physical contact with said container for providing an electrical signal to said electrical circuit means to permit said twist locks to be locked only when said proximity sensing means positively indicate the proximity of the cargo container to the spreader.

2. The spreader as set forth in claim 1 wherein said proximity sensing means in combination with said electrical circuit means inhibits the unlocking of said twist locks while said container is engaged with said frame.

3. The spreader as set forth in claim 1 wherein said proximity sensing means includes proximity switches located at the respective corner positions of said spreader.

4. The spreader as set forth in claim 1 wherein said spreader includes radio-receiving means in combination with said electrical circuit means for receiving a transmitted signal to lock or unlock said twist locks.

5. The spreader as set forth in claim 1 further including limit switching means responsive to said twist lock actuating means for indicating when said twist locks are in a locked or unlocked position.

6. The spreader as set forth in claim 1 wherein said twist lock actuating means includes a rotatable twist lock, a twist lock actuator for rotating said twist locks between a locked and unlocked position and a laterally translatable twist lock actuating member to rotate said twist locks between a locked and unlocked position, limit switch contactors being located on said twist lock actuator.

7. The spreader as set forth in claim 1 further including corner aligning arms in said frame, said electrical circuit means including means for raising or lowering said aligning arms upon command and said hydraulic means including means for maintaining the static hydraulic pressure applied to said raising or lowering means to retain the aligning arms in the position commanded at the time of cessation of the raising or lowering command.

8. The spreader as set forth in claim 7 wherein said spreader includes means for receiving a radio signal commanding the raising or lowering of said aligning arms.

9. The spreader as set forth in claim 1 including a fixed portion and an expandable portion, and means for expanding and retracting said expandable portion in response to a command, said spreader further including limit switches in the expand position of said spreader which cause continuous current flow to a solenoid controlling expand cylinders for said expandable portion of said spreader.

10. The spreader as set forth in claim 9 further including means to retract said expandable portion.

11. The spreader as set forth in claim 1 further including backup safety means comprising pressure sensitive means responsive to the pressure in the hydraulic twist lock circuit, said pressure switches inhibiting the locking of the twist locks above a predetermined pressure.

12. The spreader as set forth in claim 11 further including warning means in circuit with said circuit pressure sensitive means.

13. A spreader for a cargo container comprising:

a frame;

corner aligning arms capable of assuming an upward or downward position located at the opposed corners of said frame for aligning twist locks on said spreader to a container;

proximity sensing means for sensing the proximity of said spreader to said cargo container for permitting the actuating of said lock circuit means when said proximity sensing means indicate the approximate proximity of the cargo container and inhibiting said locking while away from said container; and means for sensing hydraulic pressure in the locking circuit for said twist locks for inhibiting the unlocking of said twist locks when the pressure in said hydraulic circuit exceeds a predetermined setting.

* * * * *